US007661340B2

(12) United States Patent
Xu

(10) Patent No.: US 7,661,340 B2
(45) Date of Patent: Feb. 16, 2010

(54) SCREW FASTENING DEVICE

(76) Inventor: Jun-Xiu Xu, No. 48-16, Chiang-Shan Rd., Chiang-Shan Tsun, Ta Liao Hsiang, Kaohsiung Hsien (TW)

( * ) Notice: Subject to any disclaimer, the term of this patent is extended or adjusted under 35 U.S.C. 154(b) by 0 days.

(21) Appl. No.: 12/178,664

(22) Filed: Jul. 24, 2008

(65) Prior Publication Data

US 2008/0289458 A1 Nov. 27, 2008

Related U.S. Application Data

(62) Division of application No. 11/682,322, filed on Mar. 6, 2007, now Pat. No. 7,487,699.

(51) Int. Cl.
*B25B 23/04* (2006.01)

(52) U.S. Cl. ..... 81/434; 81/57.37

(58) Field of Classification Search ..... 81/57.37, 81/431, 433–435

See application file for complete search history.

(56) References Cited

U.S. PATENT DOCUMENTS 4,428,261 A * 1/1984 Takatsu et al. ..... 81/434
4,774,863 A * 10/1988 Geist ..... 81/434
5,101,697 A * 4/1992 Fishback ..... 81/434
5,167,174 A * 12/1992 Fujiyama et al. ..... 81/434
5,664,468 A * 9/1997 Murayama et al. ..... 81/434
6,655,573 B1 * 12/2003 Chang et al. ..... 227/109
6,676,001 B1 * 1/2004 Chen et al. ..... 227/119
6,769,332 B2 * 8/2004 Muro ..... 81/434
6,904,834 B2 * 6/2005 Lin ..... 81/434
6,915,724 B2 * 7/2005 Kigel et al. ..... 81/434
7,032,482 B1 * 4/2006 Hoffman ..... 81/434
7,231,854 B2 * 6/2007 Kikuchi ..... 81/434
2004/0123704 A1 * 7/2004 Kigel et al. ..... 81/434
2005/0072276 A1 * 4/2005 Lin ..... 81/434
2006/0243104 A1 * 11/2006 Kikuchi ..... 81/434

* cited by examiner

*Primary Examiner*—D. S Meislin
(74) *Attorney, Agent, or Firm*—Alan Kamrath; Kamrath & Associates PA

(57) ABSTRACT

A screw fastening device allows efficient mounting and advancing of screws carried on a screw strip along a guide chute to prevent the screws from impacting a target object and damaging the target object and to precisely move the screw strip forward to precisely set the screws at a desired positioning point in a completely fixed condition and also allows for correcting the orientation of the sharp tip of the screw with a guiding and holding device and stably holding a body of the screw to prevent improper orientation of the screw and incorrect screwing thereby effectively and precisely screw the screw to a target object.

2 Claims, 17 Drawing Sheets

SCREW FASTENING DEVICE

CROSS-REFERENCE TO RELATED APPLICATION

This is a division of the patent application Ser. No. 11/682,322, filed Mar. 6, 2007, now U.S. Pat. No. 7,487,699.

BACKGROUND OF THE INVENTION (a) Technical Field of the Invention

The present invention relates to a screw fastening device, and in particular to a screw fastening device that allows efficient mounting and advancing of screws carried on a screw strip along a guide chute to prevent the screws from impacting a target object and damaging the target object and to precisely move the screw strip forward to precisely set the screws at a desired positioning point in a completely fixed condition and also allows for correcting the orientation of the sharp tip of the screw with a guiding and holding device and stably holding a body of the screw to prevent improper orientation of the screw and incorrect screwing thereby effectively and precisely screw the screw to a target object.

(b) Description of the Prior Art

Prior art of the screw fastening device, such as U.S. Pat. No. 7,032,482 B1 to Hoffman, comprises a device body, a stationary base extending from the device body, a screw strip guide rail mounted to a bottom of the stationary base, a screw-driving tool arranged in the device and extending inside the stationary base, a movable base coupled to and extending outside the stationary base and movable with respect to the stationary base, a transmission device arranged in a front end inside the movable base, a connection guide board arranged at a bottom inside the movable base and mountable to the screw strip guide rail, and a positioner arranged at the front end of the movable base. The known device is characterized in that a front end of the connection guide board is coupled to a screw inlet slot at the bottom inside the stationary base by a connection block and a rear end of the connection guide board is directly inserted into the screw strip guide slot. A chute block is mounted to the bottom of the front end of the connection guide board whereby a screw strip is assembleable to and extends beyond a top end of the screw strip guide rail to pass through a chute block on the connection guide board and eventually enters the transmission device of the screw inlet slot to allow the screw strip to be guided by the chute block of the connection guide board, after it disengages from the screw strip guide rail, so as to prevent the screw strip from arbitrary movement. However, when the conventional device is put in a vertical condition and a screw on the screw strip is gradually screwed into a target object and a tail end of the screw strip moves out of and disengages from the chute block, the tail end of the screw strip is out of guidance of the chute block and is in a free suspension condition, under which the tail end of the screw strip, under the action of the gravity thereof, is moved downward to approach the target object. Since the screw fastening device is continuously moved and operated, the tail end of the screw strip in free suspension condition is shaken and arbitrarily moved, causing impact between the screws on the screw strip and a wooden target object and leading to damage of the surface of the target object by sharp tips of the screws and thus damage to aesthetics of the target object. Further, in the conventional device, the screw strip has to pass through the screw strip guide rail and the chute block of the connection guide board in order to enter the transmission device of the screw inlet slot to completely mounting of the screw strip to the device. This is a complicated and troublesome process.

Other known devices, such as U.S. Pat. No. 5,083,483 to Takagi, U.S. Pat. No. 5,339,713 to Hou, U.S. Pat. No. 5,687,624 to Tsuge et al., U.S. Pat. No. 5,889,126 to Fujiyama et al., U.S. Pat. No. 5,988,025 to Sasaki et al., and U.S. Pat. No. 5,988,026 to Reckelhoff et al., all disclose a screw fastening device comprising, as a primary part, a toothed circular body having teeth engageable engaging slots formed on opposite side edges of a screw strip. The toothed circular bodies of the conventional devices are coupled to transmissions of different types to effect advancing of the screw strip. However, this arrangement comprises a variety of parts, which is more likely to cause potential failure of the parts and is more complicated in assembling and maintenance so that reduction of costs is not possible. Further, advancing the screw strip forward with the teeth of the toothed circular body is subject to over-operation or under-operation by an operator with excessive force (screw strip moved too fast) or insufficient force (screw strip moved too slow), whereby the moving speed of the screw strip caused by the teeth of the toothed circular body may not match with the forward pushing operation of the screw-driving tool and thus the screw-driving tool may fail to properly align to the screw for screwing operation. Further, in case the screws carried on the screw strip have an excessive length, the overall weight of the screw strip is unduly increased so that the teeth of the toothed circular body are not able to support the weight, leading to shaking of the screw strip and improper orientation of the screws and imprecise positioning of the screws at desired locations for screwing.

Further, Taiwan Utility Model No. M268145 discloses a screw holding structure that comprises two holding bases that are rotated outward at the time the head of a screw passes therethrough and that are returned to the original position by springs so that the holding bases function to stably hold the screw at the time of screwing operation and also provides opening/closing operation to allow smooth passage of the screw. Although the conventional device provides stable holding of the screw by the holding bases at the time of screwing the screw onto a target object, the two holding bases are pivotally mounted to a casing of a screw pushing device at locations close to an outlet of an operation tube of the screw fastening device so that when the screw is advanced into a screw inlet slot of the casing of the screw pushing device to be driven by the operation tube of the screw fastening device, recesses of the two holding bases can only effectively hold the head of the screw, but the sharp tip of the screw is not held by any members. Apparently, when the screw is driven forward to completely pass the holding bases but the sharp tip does not reach the target object, the screw is in a condition that the screw is not held and supported by the two holding bases and that the screw is not subject to any further support by other members. Any external force applied to the screw makes the sharp tip of the screw that is being forward driven inclined and no longer in proper alignment with the target object. In addition, for screws of excessive length, the weight is increased. Thus, when the screws of excessive length are driven forward to have the head completely pass the holding bases, the sharp tip of the screw is caused by the weight thereof to incline downward, leading to improper alignment to the target object or even jamming of screw. Thus, the known device still suffers the drawback of incapability of supporting and holding the sharp tip of the screw and thus being easy to incline when the screw is driven forward, leading to improper alignment of the screw to the target object.

Thus, it is desired to provide a screw fastening device to overcome the above discussed problems associated with the conventional devices.

SUMMARY OF THE INVENTION

The primary purpose of the present invention is to provide a screw fastening device that allows efficient mounting and advancing of screws carried on a screw strip along a guide chute to prevent the screws from impacting a target object and damaging the target object and to precisely move the screw strip forward to precisely set the screws at a desired positioning point in a completely fixed condition and also allows for correcting the orientation of the sharp tip of the screw with a guiding and holding device and stably holding a body of the screw to prevent improper orientation of the screw and incorrect screwing thereby effectively and precisely screw the screw to a target object.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
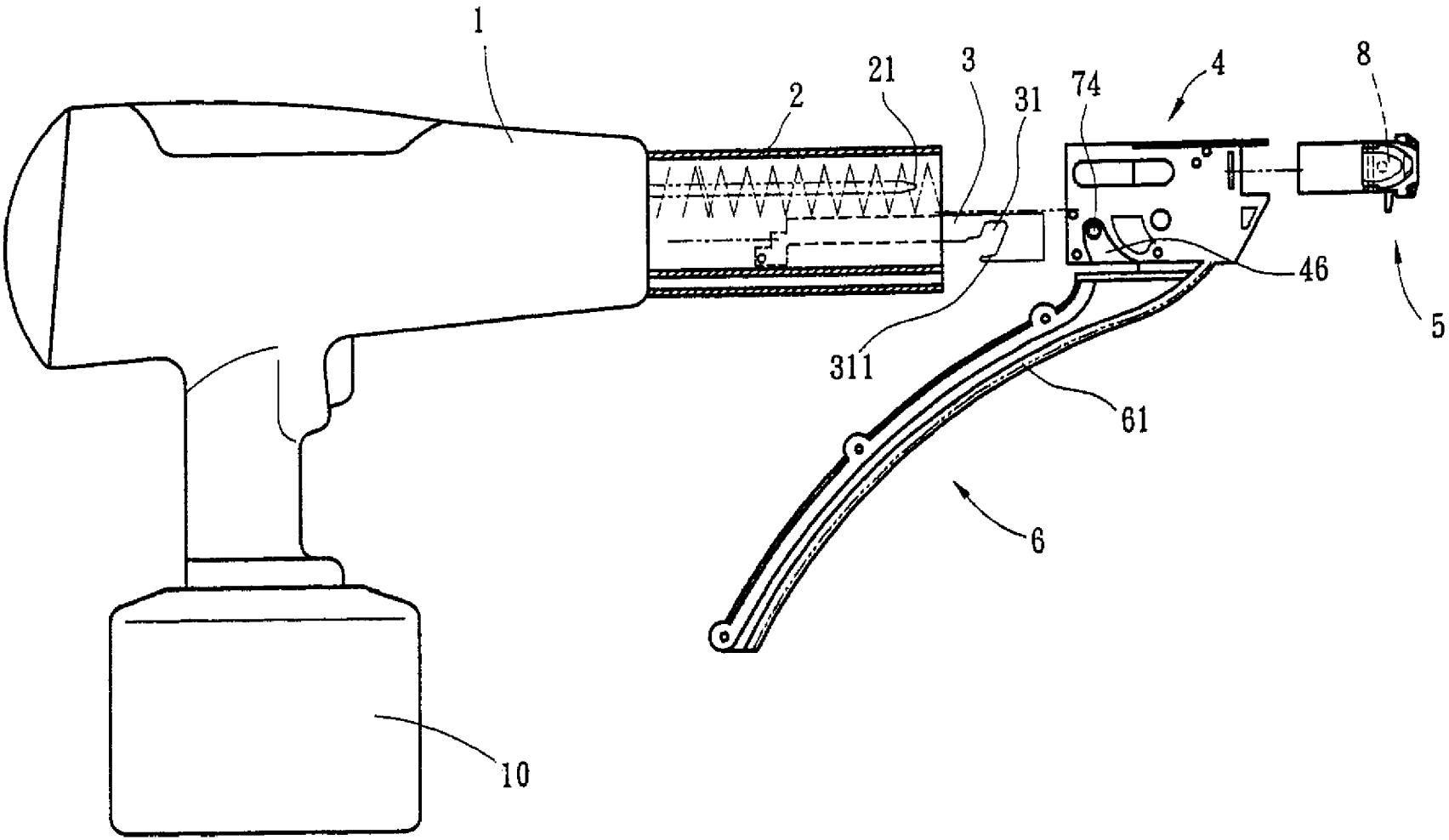
FIG. 1 is a partially exploded view of a screw fastening device constructed in accordance with the present invention.
Figure 2:
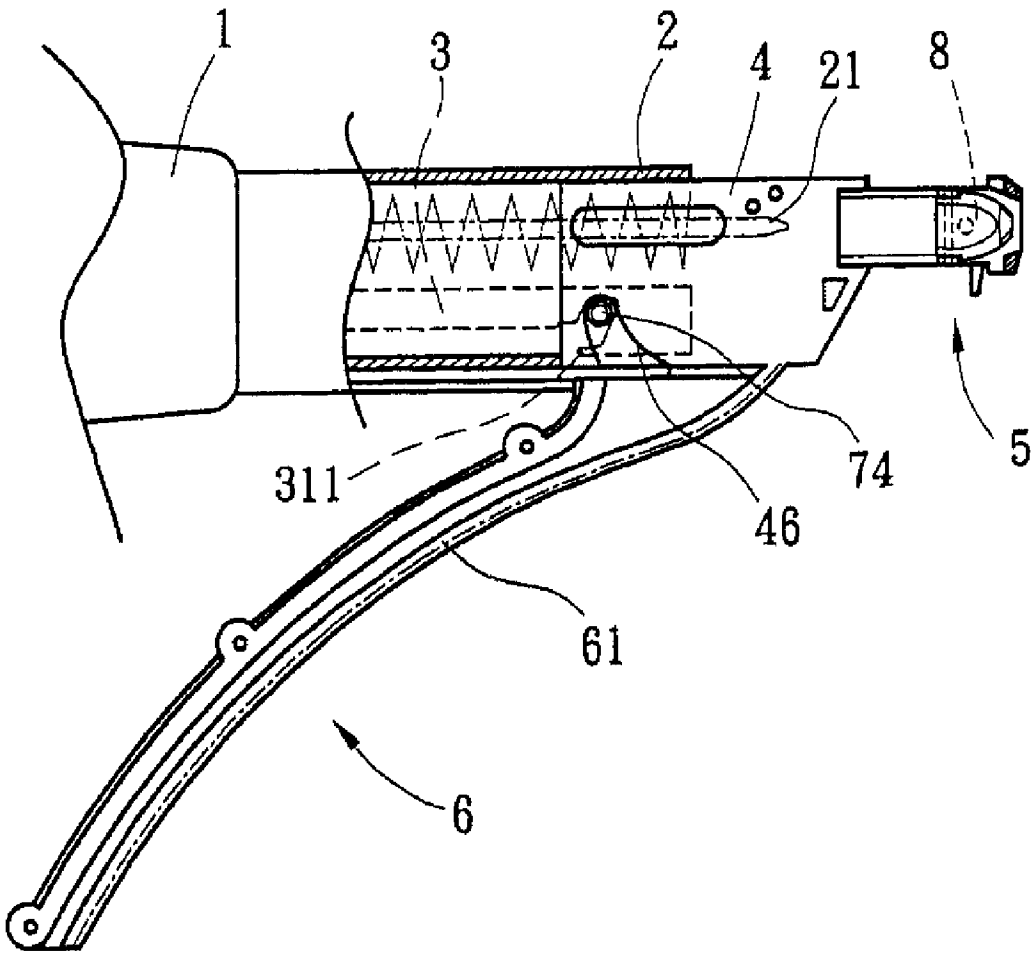
FIG. 2 is an assembled view of the screw fastening device of the present invention.
Figure 3:
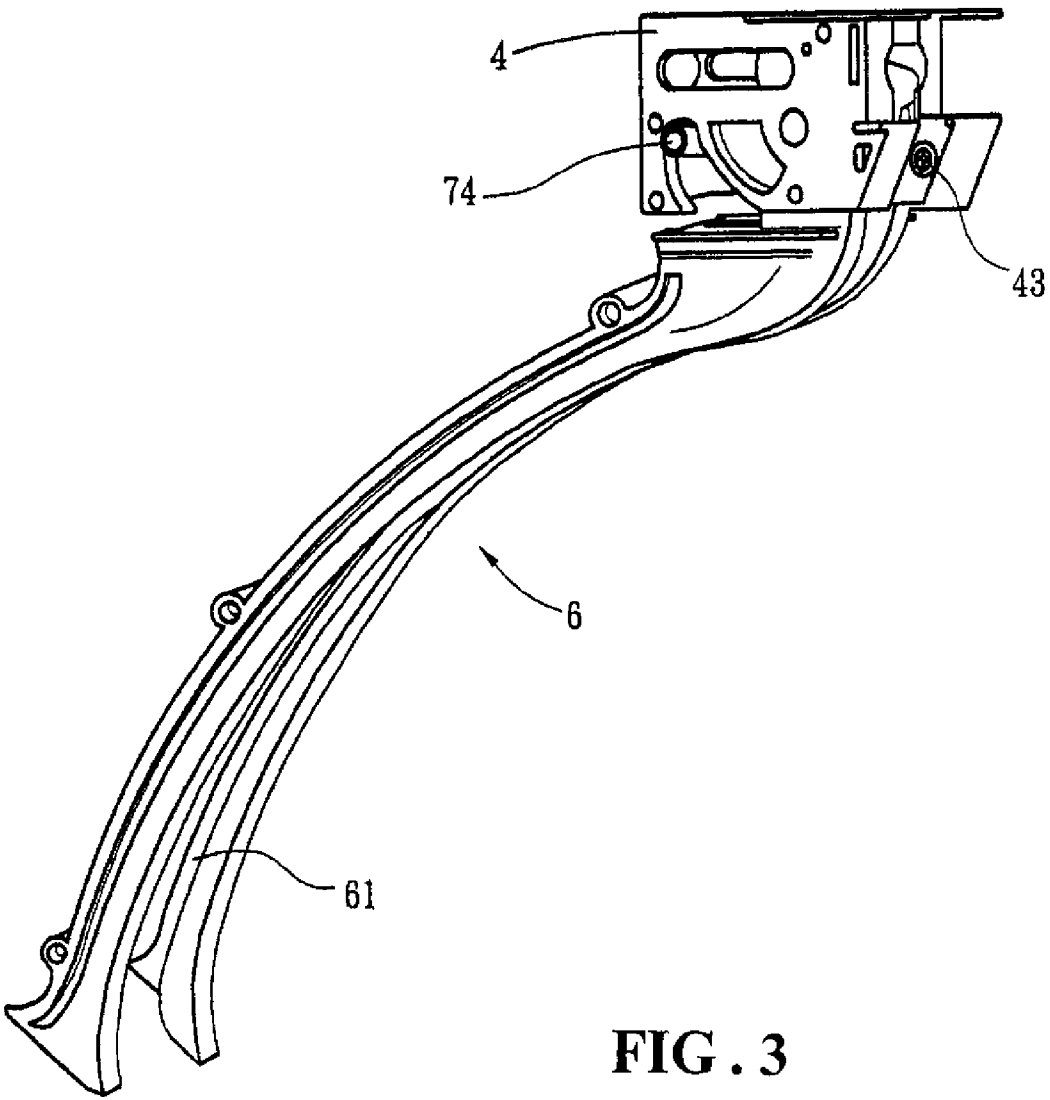
FIG. 3 is a perspective view of a movable base and a guide rail of the screw fastening device of the present invention.
Figure 4:
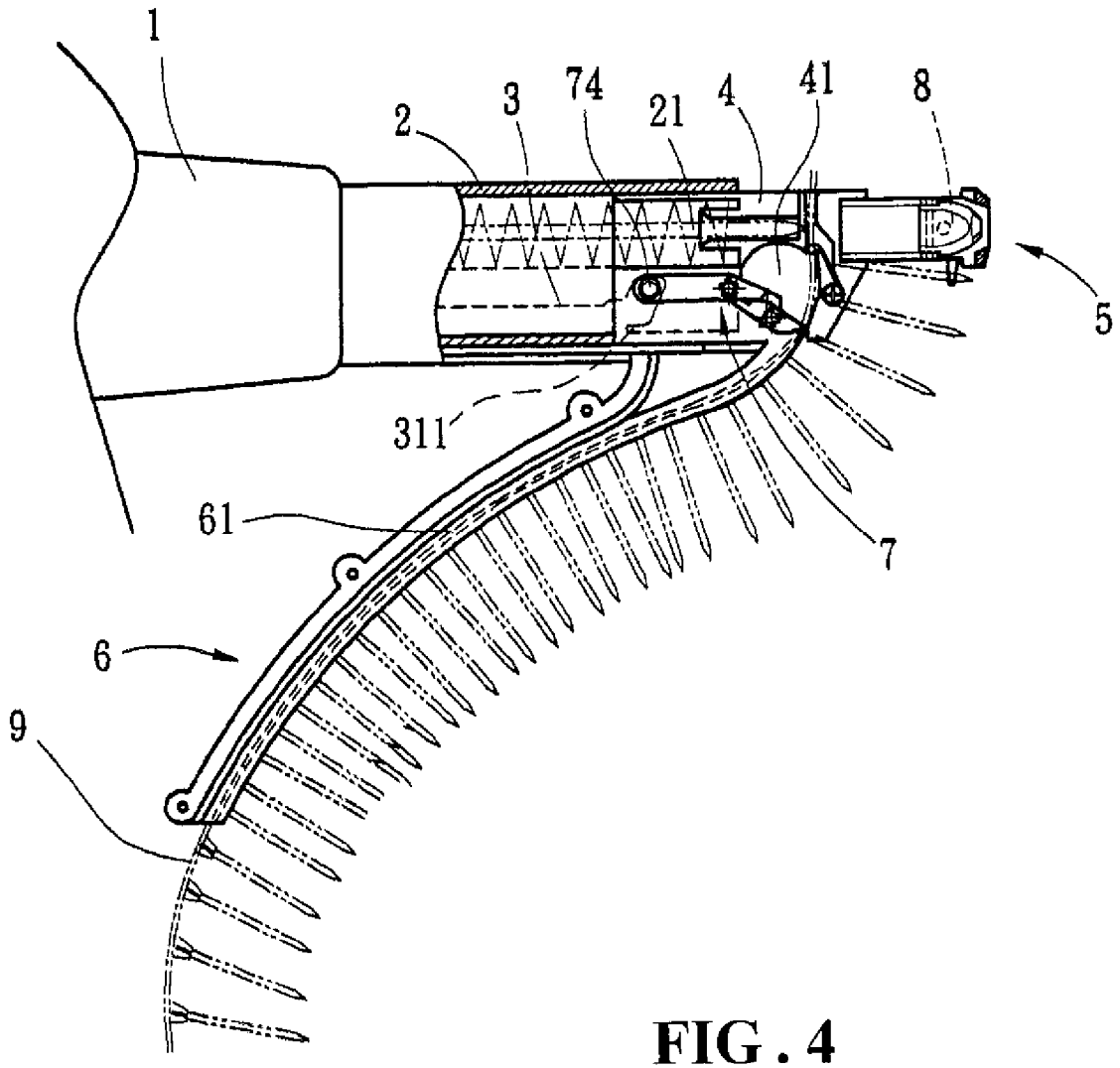
FIG. 4 is an assembled view of a guide block, the guide rail, a screw-guiding transmission device, and a guiding and holding device of the screw fastening device of the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

With reference to the drawings and in particular to FIGS. 1-4, a screw fastening device constructed in accordance with the present invention comprises a device body 1 from which a stationary base 2 extends frontward, a guide block 3 threadingly fixed to an inside surface of the stationary base 2, a movable base 4 coupled to and extending outside the stationary base 2 and movable with respect to the stationary base 2, a positioner 5 fixed to and projecting from a front end of the movable base 4, a guide rail 6 extending from a bottom of the movable base 4, a screw-guiding transmission device 7 arranged at a suitable location inside the movable base 4, and a guiding and holding device 8 mounted inside a front portion of the positioner 5. The device body 1, the stationary base 2, and the positioner 5 are all similar or identical to the counterparts of the conventional screw fastening devices and are thus not further described. The novel features of the screw fastening device of the present invention reside in the novel construction of the guide block 3 and the guide rail 6, the screw-guiding transmission device 7, and the guiding and holding device 8 of the movable base 4.

The guide block 3 is in the form of a plate and is threadingly fixed to the inside surface of the stationary base 2. The guide block 3 has a front end portion in which a slightly inclined U-shaped recess 31 is formed at a suitable location corresponding to a curved slot 46 defined in the movable base 4 to serve as a slide chute that guides sliding movement of a peg 74. At a bottom edge of a front bank of the U-shaped chute 31, a stop flange 311 is provided and extends rearward by a suitable length. The bank of the chute 31 that is opposite to the stop flange 311 in an upward-inclined direction forms a receiving edge. Thus, when the peg 74 is moved from a top end of the slightly inclined U-shaped chute 31 in a rearward-downward direction, the peg 74 encounters and is temporarily stopped by the stop flange 311 and is thereafter guided to horizontally and linearly move in the rearward direction to thereby eliminate the trouble that a screw 91 is not precisely located at a desired positioning point due to an excessive instantaneous force at the time the peg 74 slides downward.

Figure 5:
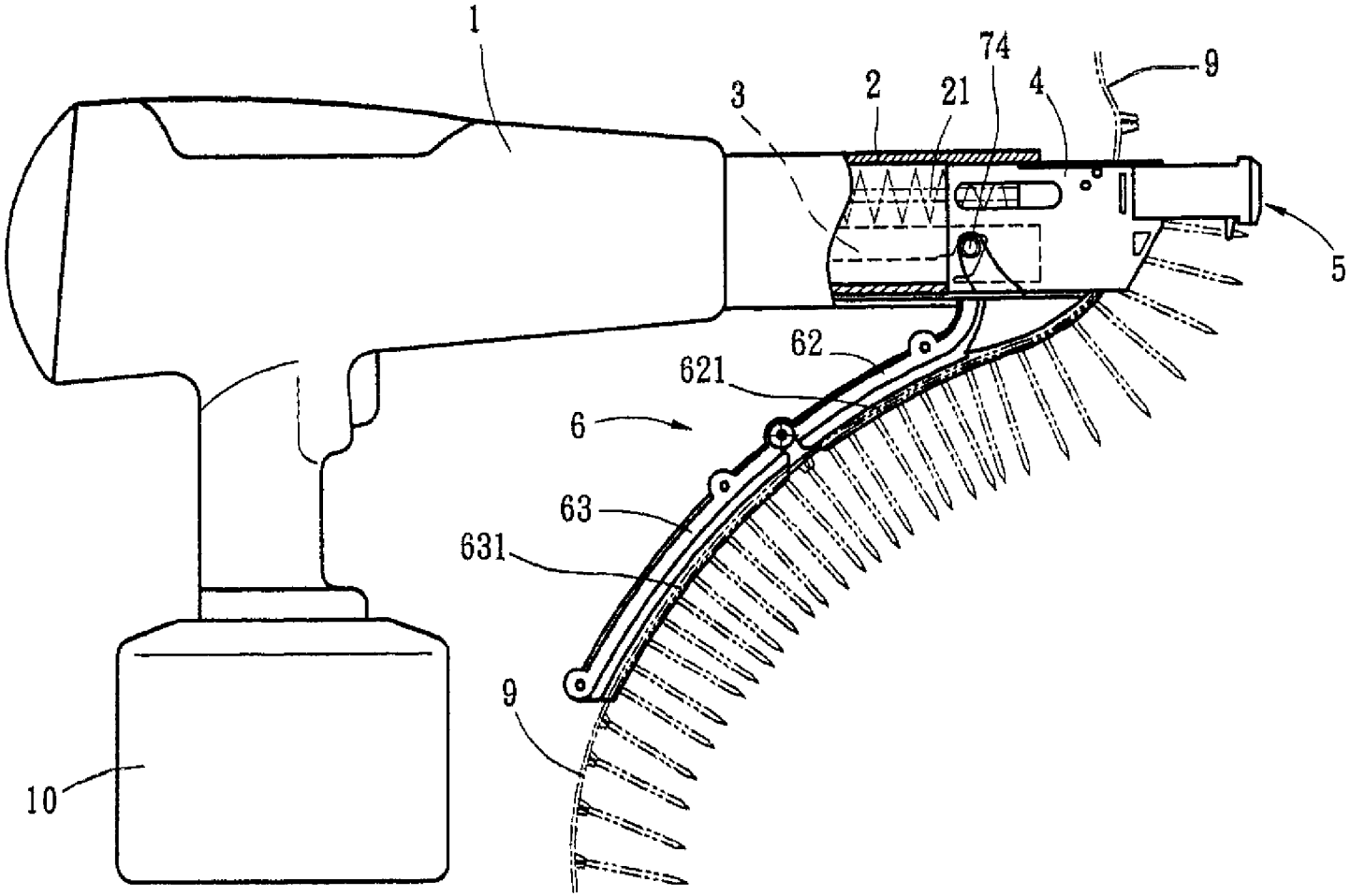
FIG. 5 is an assembled view of the screw fastening device of the present invention illustrating another embodiment of the guide rail.
Figure 6:
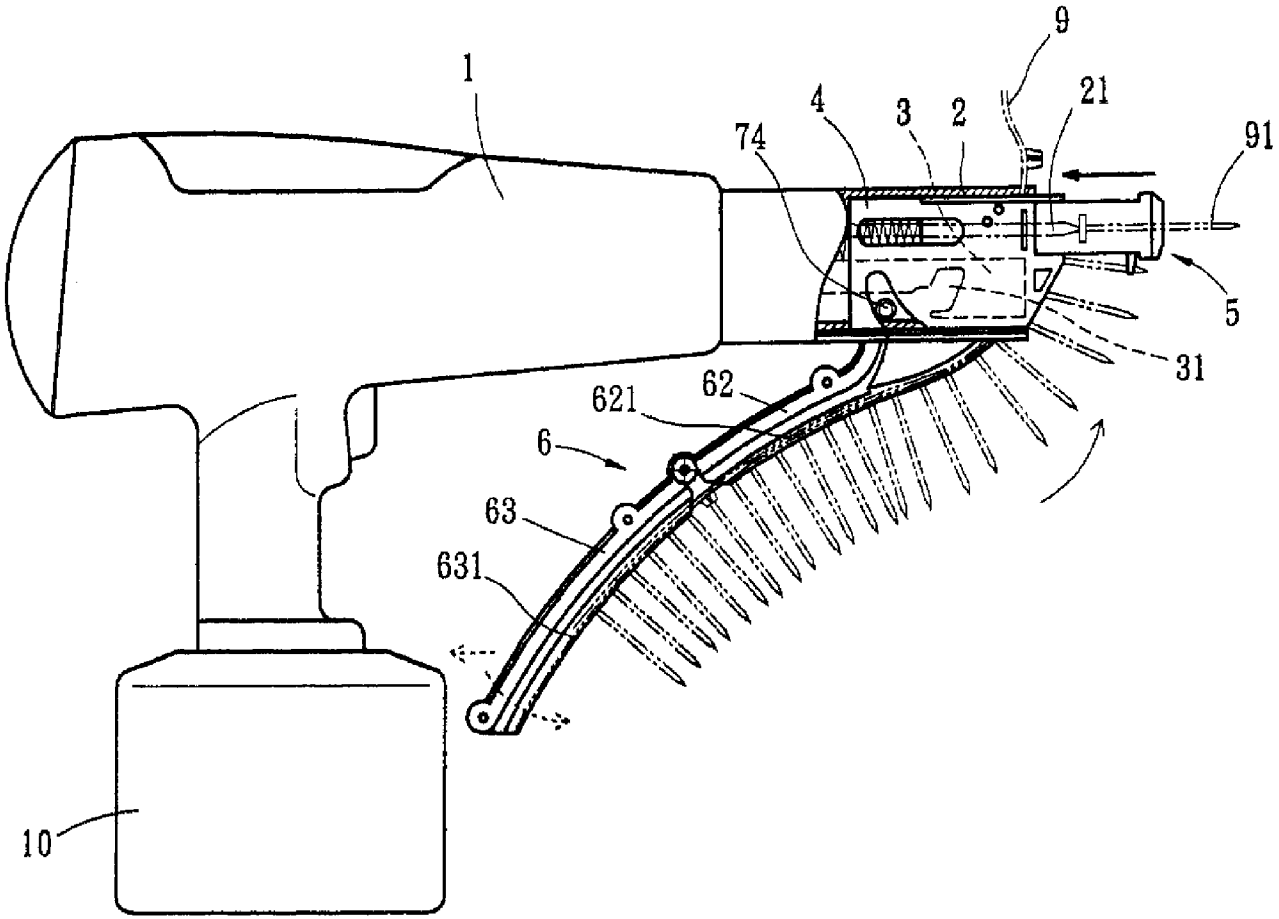
FIG. 6 is an assembled view of the screw fastening device of the present invention illustrating said another embodiment of the guide rail in a different condition.
Figure 7:
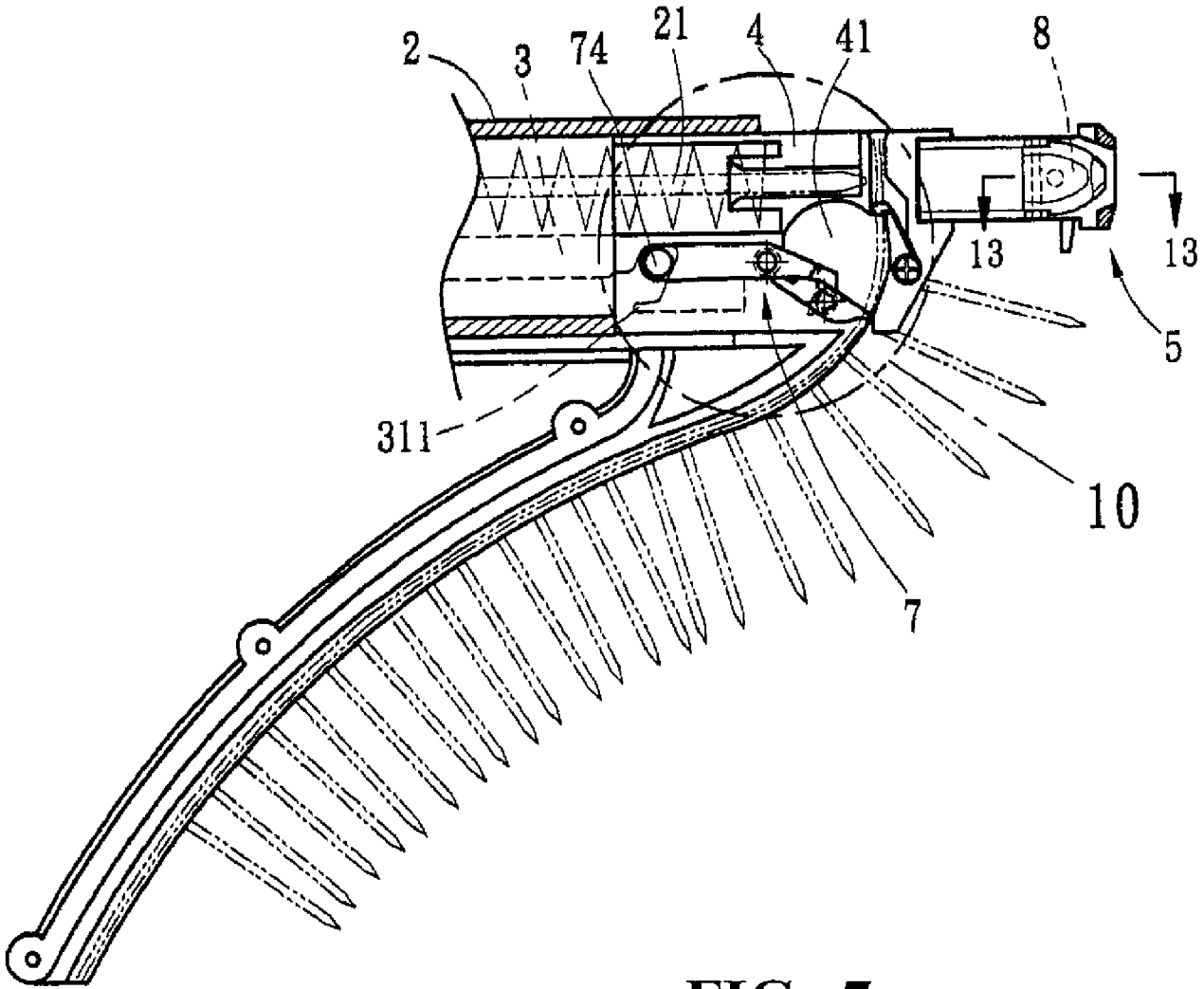
FIG. 7 is an assembled view of the guide block, the screw-guiding transmission device, and the guiding and holding device of the screw fastening device of the present invention.
Figure 8:
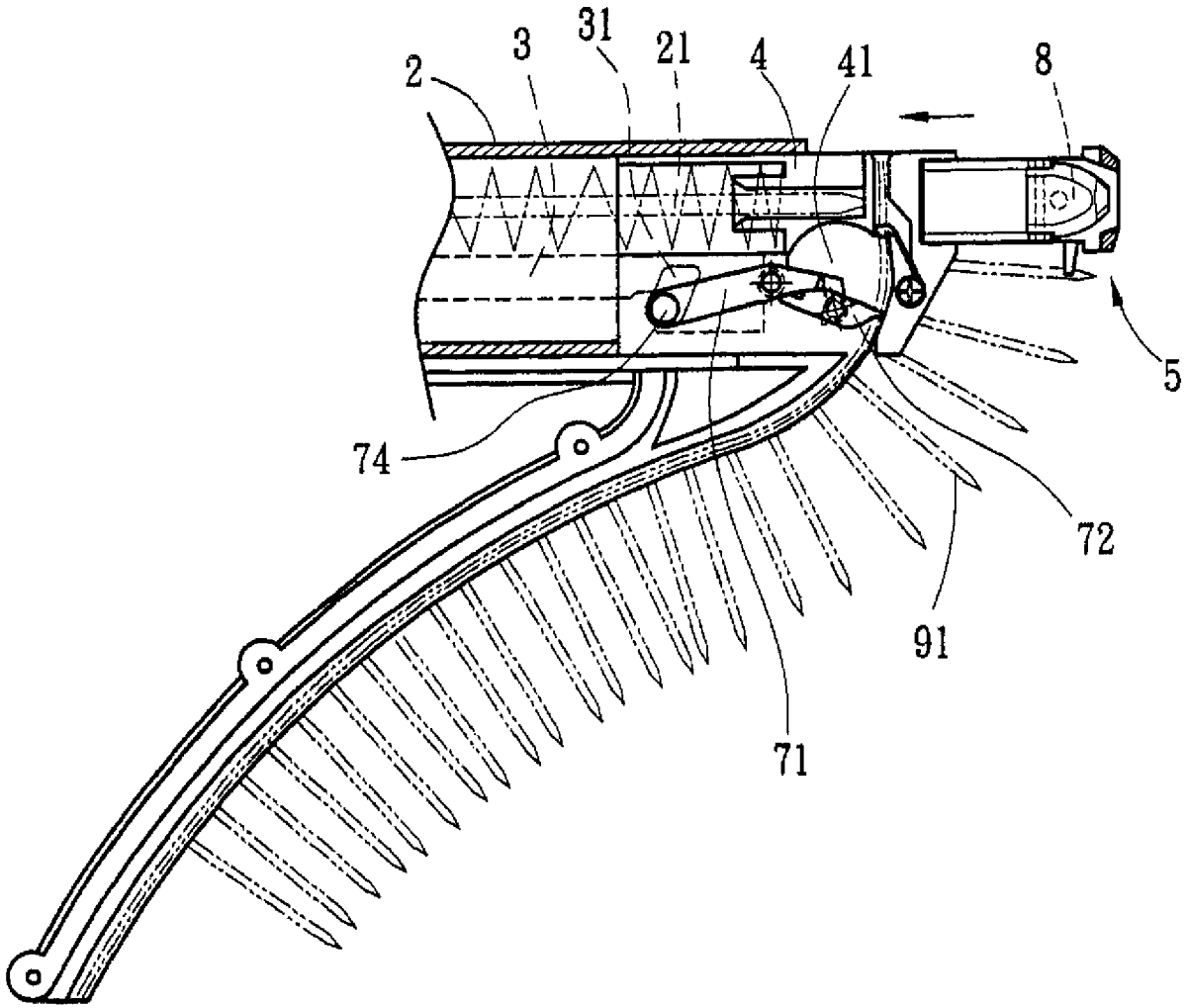
FIG. 8 is an assembled view of the guide block and the screw-guiding transmission device, illustrating the operation thereof.
Figure 9:
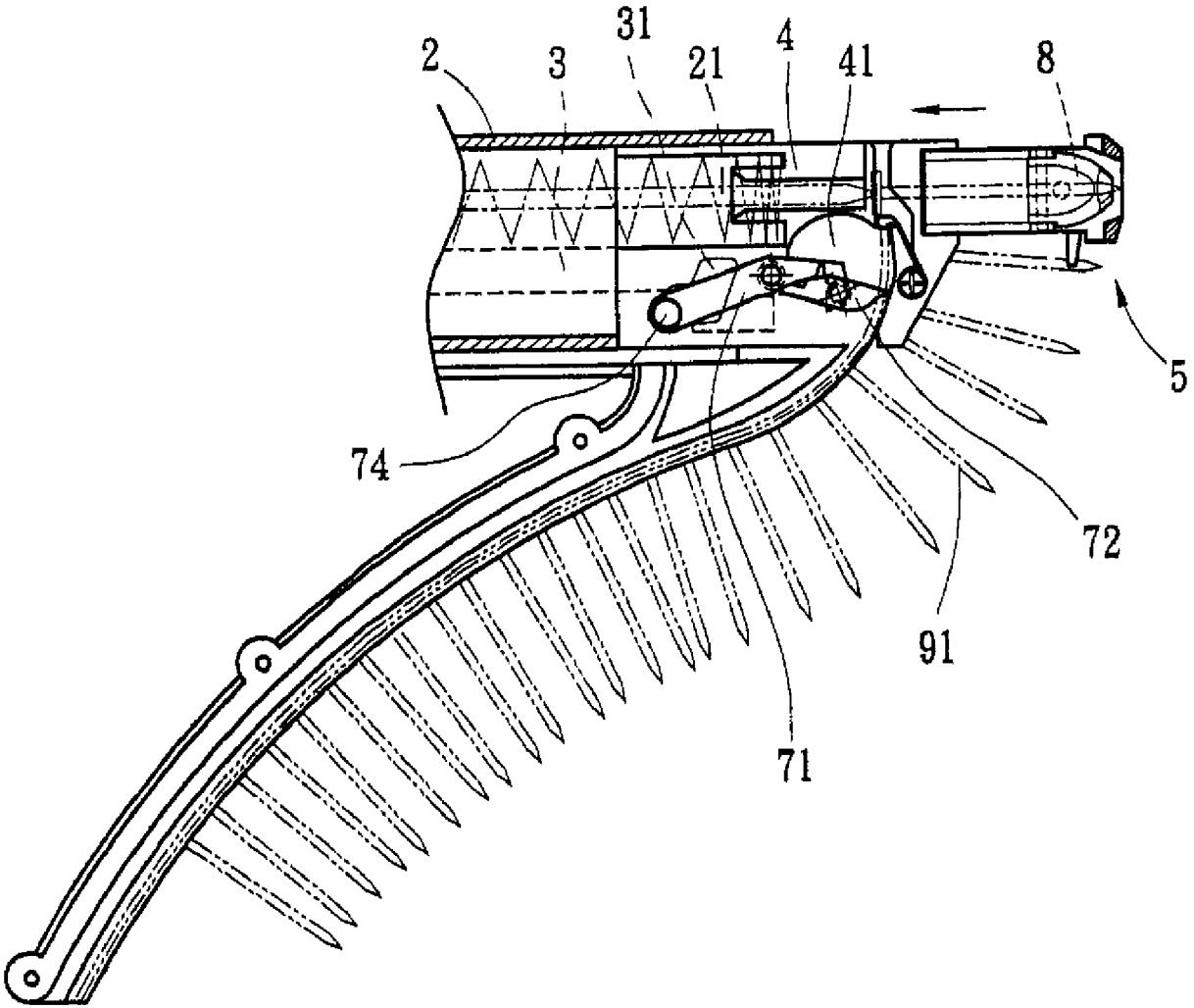
FIG. 9 is an assembled view of the guide block and the screw-guiding transmission device, illustrating the operation thereof in a different condition.
Figure 10:
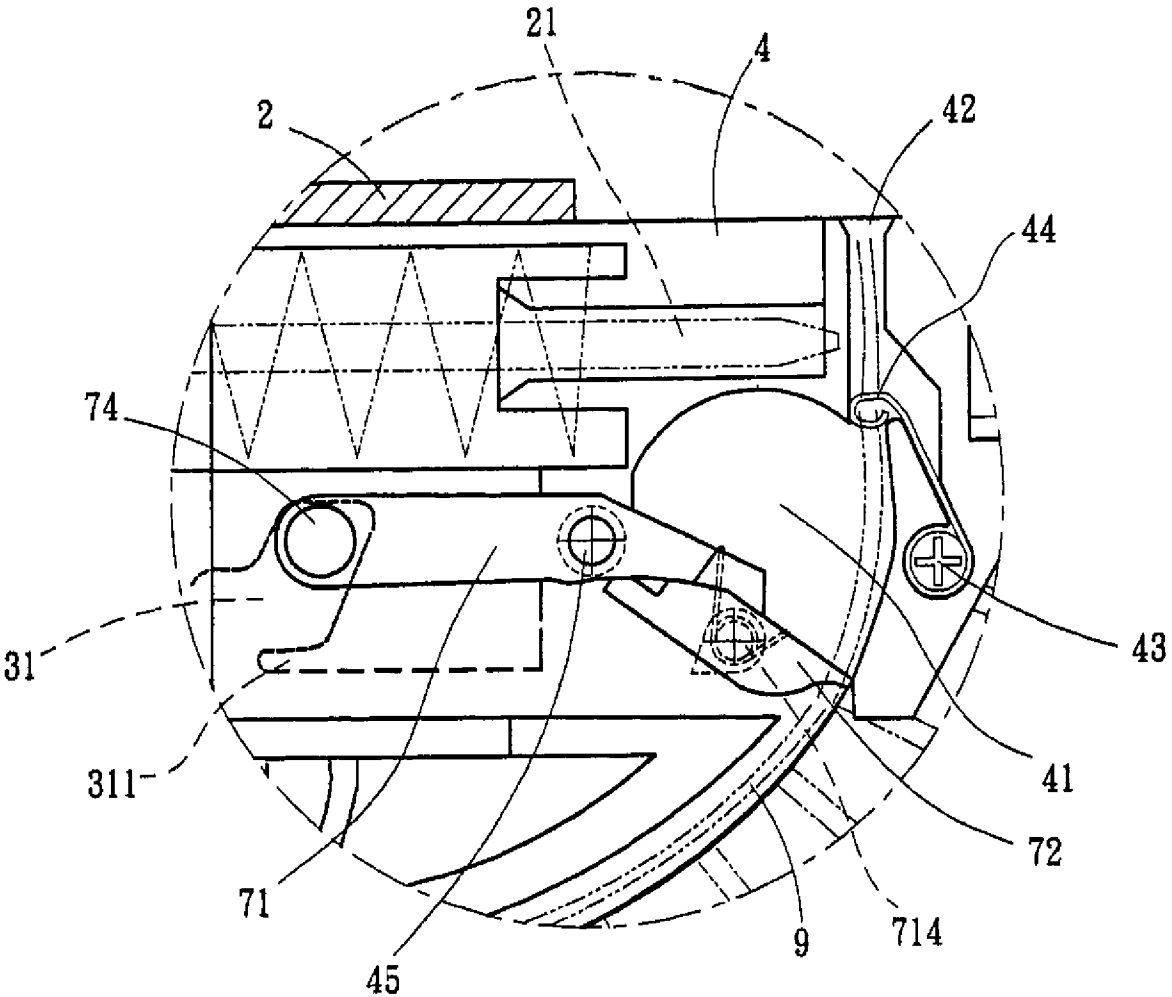
FIG. 10 is an enlarged view of the circled portion indicated by reference 10 in FIG. 7.

The movable base 4 is composed of left and right halves that are integrally formed respectively. The curved guide rail 6 extends from the bottoms of the left and right halves of the movable base 4. A front surface of the guide rail 6 is recessed, forming a guide chute 61, which is extended upwardly and in a curved configuration from a lower end to a chamber 41 defined in the movable base 4. The screw-guiding transmission device 7 is arranged at a suitable location inside the chamber 41. To operate, a user may pass a leading end of a screw strip 9, which carries a plurality of screws 91, through the guide chute 61 from the lower end of the guide rail 6, and following the curved guide chute 61 to extend upward until the leading end of the screw strip 9 reaches the screw-guiding transmission device 7 that is arranged inside the chamber 41 of the movable base 4 with opposite side edges of the screw strip 9 engaging the screw-guiding transmission device 7 thereby completing assembling of the screw strip 9 to the guide rail 6. Further referring to FIGS. 5 and 6, which show another embodiment of the guide rail 6 in accordance with the present invention. As shown in FIG. 5, the guide rail 6 of the present invention comprises an upper rail member 62 and a lower rail member 63, which are pivoted together. The upper rail member 62 forms a guide chute 621 is aligned with a guide chute 631 of the lower rail member 63 for mounting/assembling the screw strip 9 thereto. The upper rail member 62 is integrally and downward extended from the bottom of the movable base 4 and has a lower end on which a lower pivot pin is provided for pivotally connecting the lower rail member 63. An upper end of the lower rail member 63 forms a pivoting portion that corresponds to the lower pivot pin of the upper rail member 62 for pivotal connection therewith. A spring is arranged between the lower pivot pin and the pivoting portion to provide a spring force to thereby provide the lower rail member 63 with a resilient returning force, so that the lower rail member 63 may move frontward when it gets into contact with a rechargeable battery 10, as shown in FIG. 6. Thus, when the upper rail member 62 and the lower rail member 63 are connected together by means of the lower pivot pin and the pivoting portion to form the guide rail 6, the leading end of the screw strip 9 is allowed to get into the guide chute 621 of the lower rail member 62 through a lower end thereof, and getting out of the guide chute 621 through an upper end of the lower rail member 62, and the leading end is further guided into the guide chute 631 of the upper rail member 63 through a lower end thereof and further extended upward along the guide chute 631 until the leading edge of the screw strip 9 gets into the chamber 41 inside the movable base 4 to allow the opposite side edges of the screw strip 9 to engage the screw-guiding transmission device 7. This completes the assembling of the screw strip 9 to the screw fastening device of the present invention.

Figure 11:
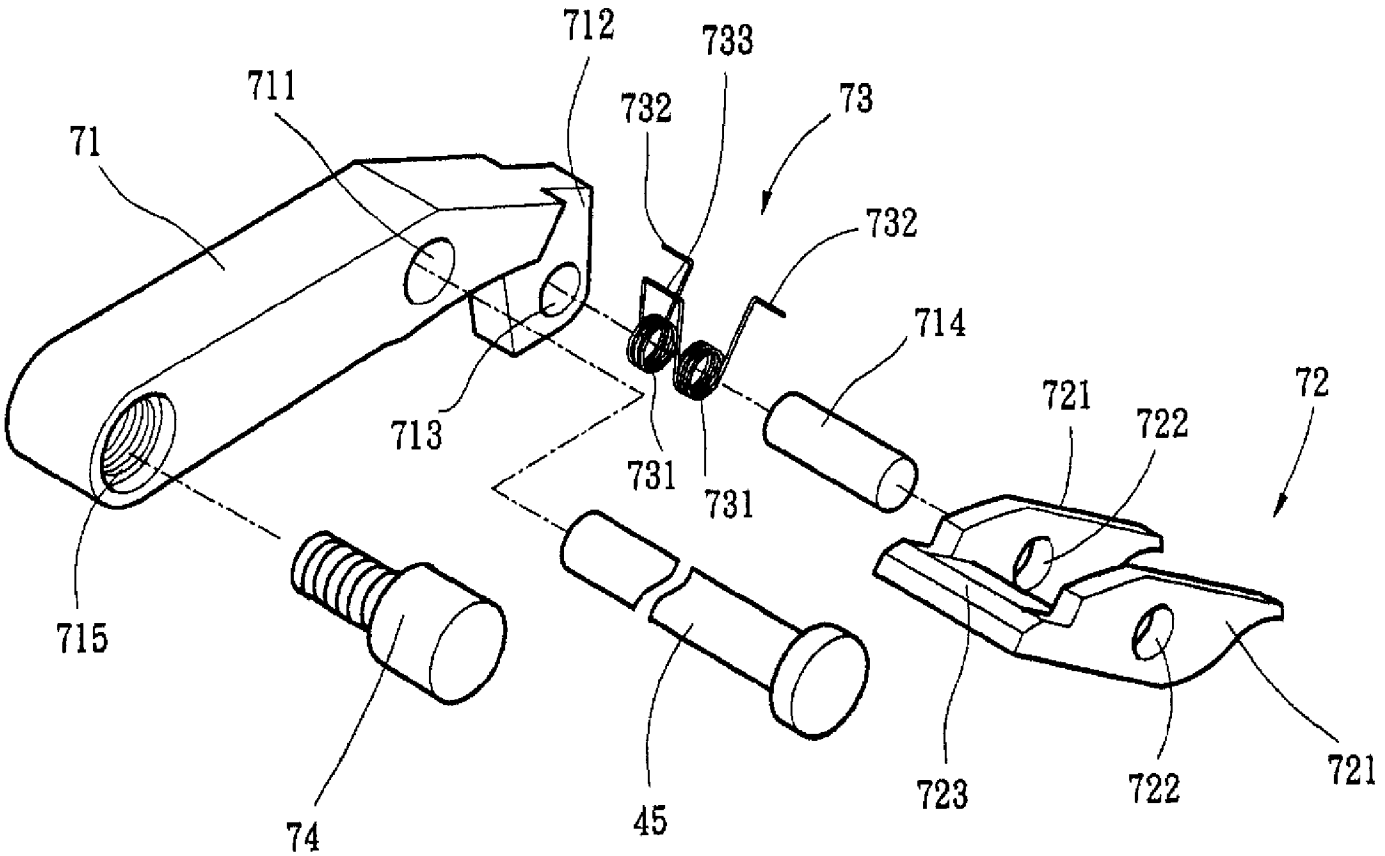
FIG. 11 is an exploded view of a transmission bar, a driving block, a spring, and a peg of the screw-guiding transmission device of the screw fastening device of the present invention.

The screw-guiding transmission device 7 is mounted in the chamber 41 that is defined inside the movable base 4, as shown in FIGS. 7-11. At a suitable location above a front curved edge of the chamber 41, a strip discharge slot 42 is formed and extending in a vertical direction. The strip discharge slot 42 is arranged to substantially align to the guide chute 61 to allow the screw strip 9 to pass therethrough for assembling and operation. Further, at a suitable location at one side of the front curved edge of the chamber 41, a threaded hole is defined for threadingly fixing a bolt 43. A channel is extended from the threaded hole and inclinedly corresponding to the strip discharge slot 42 for retaining a retention resilient plate 44. A lower end of the retention resilient plate 44 is fixed by the bolt 43 and an upper end is extended and substantially located below the strip discharge slot 42 to engage engaging slots of the screw strip 9. A shaft 45 is arranged at a suitable location inside the chamber 41 and the shaft 45 extends through and rotatably supports a transmission bar 71 of the screw-guiding transmission device 7. The screw-guiding transmission device 7 is comprised of the transmission bar 71, a driving block 72, a spring 73, and the peg 74. As shown in FIG. 11, the transmission bar 71 forms a through hole 711 rotatably fitting over the shaft 45 so that the transmission bar 71 can be secured fixed inside the chamber 41 and rotates about the shaft 45. A front end of the transmission bar 72 is extended downward to form a pivot portion 712 through which a hole 713 is formed for the extension of a pin 714 for mounting the driving block 72 on opposite sides of the pivot portion 712. The driving block 72 has a substantially U-shape, comprising two side boards 721 with a hole 722 defined at a substantially central portion of each side board 72. The two holes 722 are aligned with each other and the hole 713 of the pivot portion 712. A stop block 723 is formed at a rear portion between the two side boards 721. The stop block 723 is abuttingly engageable with a bottom surface of a front portion of the transmission bar 71 at a suitable location. The spring 73 is received between inside faces of the two side boards 721 of the driving block 72. The spring 73 comprises two coils 731 that are integrally formed and located on opposite side portions to be substantially aligned with each other. The coils 731 are also aligned with the holes 722 of the two side boards 721 and the hole 713. An L-shaped hook 732 is extended from and formed at a front side of each coil 731 and a U-shaped connection 733 is formed between the coils 731 at a rear side thereof The hooks 732 are engageable with suitable locations at upper edges of the two side boards 721, respectively so that when the pivot portion 712 provided at the front end of the transmission bar 71 is received between the two coils 731 of the spring 73 and the two side boards 721 of the driving block 72, the pin 714 is allowed to extend through the holes 722, the coils 731, and the hole 713 with the stop block 723 that is provided at the rear side of the driving block 72 abutting against the bottom surface of the front portion of the transmission bar 71. At the same time, the U-shaped connection 733 at the rear side of the spring 73 is put against at a suitable location on a top surface of the front portion of the transmission bar 71. By this arrangement, the driving block 72 and the spring 73 are securely fixed to the pivot portion 712 at the front end of the transmission bar 71 and the driving block 72 is allowed to take up and down reciprocal movement about a center defined by the pin 714 on the pivot portion 712 under the action of the spring force of the spring 73. Front ends of the two side boards 721 of the driving block 72 are provided with a projected tooth like configuration, which has an inclined surface at a lower side thereof, to engage the engaging slots on two side edges of the screw strip 9. Thus, the front ends of the two side boards 721 of the driving block 72 may drive the screw strip 9 upward and then slide downward with the inclined surface provided at the lower side of the front end thereof so that the front ends of the two side boards 721 may move back to engage the next engaging slots of the screw strip 9. The transmission bar 71 forms a threaded hole 715 at a rear portion thereof for threadingly engaging the peg 74 and the peg 74 is also received in the curved slot 46 defined in the movable base 4 and the chute 31 of the guide block 3. With this arrangement, when the peg 74 takes up and down reciprocating movement along the chute 31 of the guide block 3, the front end of the transmission bar 71 is at the same time driven to take up and down reciprocating movement by the rotation of the transmission bar 71 about the shaft 45, thereby causing the driving block 72 to move up and down and the front ends of the side boards 721 of the driving block 72 engaging the engaging slots on the opposite sides of the screw strip 9 for moving one of the screws 91 carried on the screw strip 9 into the strip discharge slot 42 to reach a predetermined positioning point. When the screw 91 is moved with the screw strip 9 to the predetermined positioning point in the strip discharge slot 42, since the upper end of the retention resilient plate 44 is located below the strip discharge slot 42, the engaging slot that is formed at the associated side edge of the screw strip 9 can forcibly move the upper end of the retention resilient plate 44 away to allow the screw strip 9 to move upward into the strip discharge slot 42 and the engaging slot of the screw strip 9 can move upward and engage with the upper end of the retention resilient plate 44 to prevent the screw strip 9 from arbitrarily moving up and down thereby securely holding and completely fixing the screw 91 at the predetermined positioning point in the strip discharge slot 42 and thus allowing the screw 91 to be moved into the positioner 5 by a forward movement of a screw-driving tool 21. Further at the same time, due to the provision of the stop flange 311 at the chute 31 of the guide block 3, when the peg 74 is moved downward from the top end of the chute 31, the peg 74 is subject to temporary stop by the stop flange 311. The purposes of temporarily stopping the peg 74 with the stop flange 311 is to prevent the screw 91 carried by the screw strip 9 from being moved beyond the predetermined positioning point by the driving block 72 due to excessively forcible operation performed by a user that causes excessive movement of the transmission bar 71 and the driving block 72 driven by the peg 74, and eventually leading to the situation that the screw-driving tool 21 is not in precise alignment with the screw 91. Thus, the arrangement of the stop flange 311 of the guide block 3 and the retention resilient plate 44 is to stably and correctly set the screw 91 at the predetermined positioning point in the strip discharge slot 42 so as to allow the screw-driving tool 21 to correctly drive the screw 91 frontward into the positioner 5.

Figure 12:
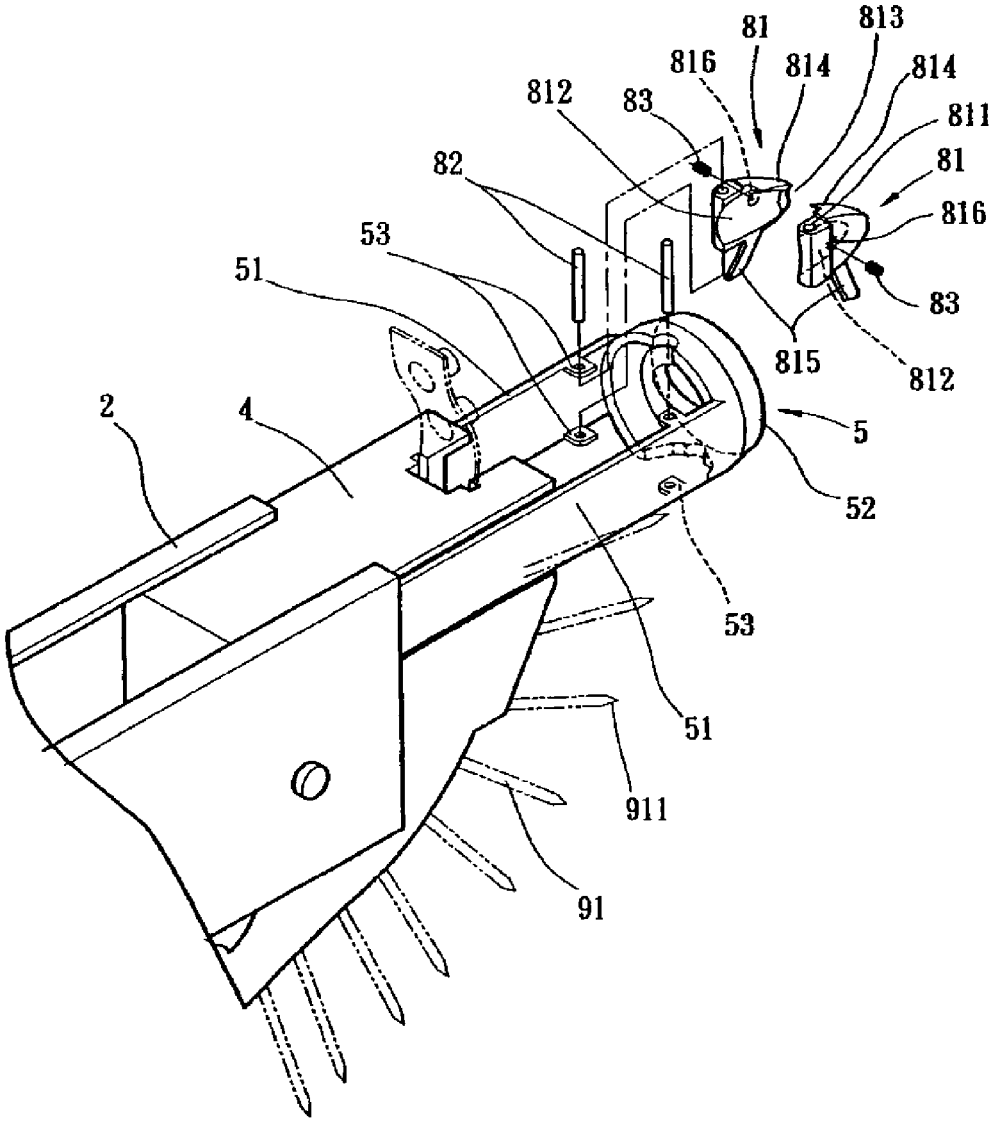
FIG. 12 is a perspective view of guiding clamp blocks, pins, and springs of the guiding and holding device of the screw fastening device of the present invention.
Figure 13:
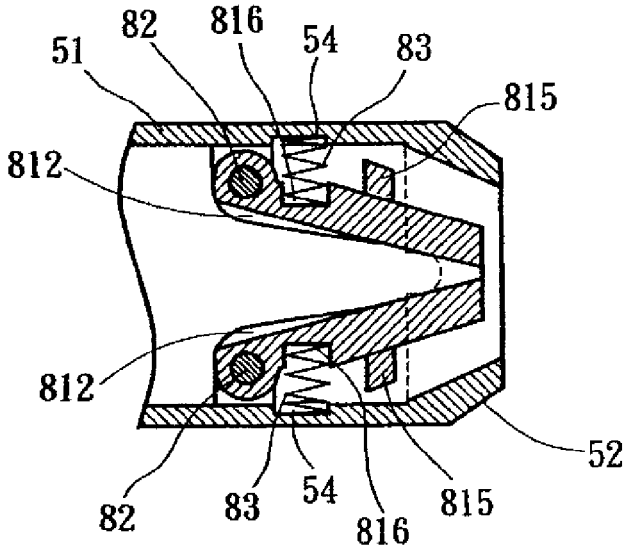
FIG. 13 is a cross-sectional view taken along line 13-13 of FIG. 7.

Referring to FIGS. 7 and 12-14, the positioner 5 is comprised of left and right halves 51 having rear ends threadingly fixed to opposite sides of a front end of the movable base 4. The left and right halves 51 each have a front end forming an abutting edge 52 in the form of a circular hollow opening. A bottom side of the abutting edge 52 forms a recess at an inner edge thereof to allow a sharp tip 911 of the screw 91 to pass therethrough to enter the guiding and holding device 8. Further, the left and right halves 51 each form at suitable locations on an inside surface thereof a pair of inward extending, vertically spaced and aligned hole-formed lugs 53 to support two pins 82 of the guiding and holding device 8. The guiding and holding device 8 is comprised of two guiding clamp blocks 81 having symmetric configurations, the pins 82, and two springs 83, as shown in FIG. 12. Holes 811 extend through rear end portions of the guiding clamp blocks 81 to correspond in position to the hole-formed lugs 53 to receive the pins 82. An arcuate recessed inclined face 812 is formed in an inside surface of each guiding clamp block 81 in an outward inclined manner from the front side to the rear side. Each guiding clamp block 81 forms a recess 813 in an inside surface of a front end and a stop cover 814 extends from top side of the recess 813 in a direction substantially along the arcuate recessed inclined face 812. The stop covers 814 of the two guiding clamp blocks 81 are symmetrically openable/closeable to selectively stop further upward movement of an upward-moving screw 91. A stop guide 815 is formed at a suitable location on a bottom of each guiding clamp block 81 and extending downward in an outward inclined manner. The two symmetric stop guides 815 are extended to inside the bottom of the abutting edge 52 and a spacing between lower ends thereof is substantially identical to the circular hollow opening like abutting edge 52 formed at the front end of the left and right halves 51. A receiving slot 816 is defined at a suitable location in an outside surface of each guiding clamp block 81 for receiving an end of the associated spring 83. The half 51 that corresponds to the receiving slot 816 forms a retention slot 54 for receiving and retaining an opposite end of the spring 83, as shown in FIG. 13. By inserting the pins 82 through the vertically aligned hole-formed lugs 53 and the holes 811, with the springs 83 respectively received in the receiving slots 816 and the corresponding retention slots 54 of the left and right halves 51, the two guiding clamp blocks 81 are securely mounted between the left and right halves 51 with the two closed recesses 813 of the front ends thereof extending and positioned at a suitable location inside the end opening of the abutting edge 52 and a space formed by the recesses 813 concentrically corresponding to the screw-driving tool 21 for allowing the screw 91 to pass therebetween. The two stop covers 814 on the top side of the recesses 813 are also closed at this situation so that when the screw 91 is moved frontward by the screw-driving tool 21 to pass, in a concentric manner, through the space formed between the recesses 813 of the front ends of the guide clamp blocks 81, since the ends of the springs 83 are respectively received and retained in the receiving slots 816 and the retention slots 54 of the corresponding left and right halves 51, the two guiding clamp blocks 81, under the action of the spring forces of the springs 83, are rotatable about the pins 82 to allow the body of the screw 91 to push the two recesses 813 outward and moving forward. At this time, the two recesses 813 also function to hold straightforward the body of the screw 91 to maintain a linear forward movement of the screw 91 until a head of the screw 91 completely passes the two recesses 813. Thereafter, due to the resilient returning forces provided by the springs 83, the recesses 813 of the front ends of the guiding clamp blocks are resiliently returned inward to close again and the screw 91 is precisely attached to a target object.

Figure 15:
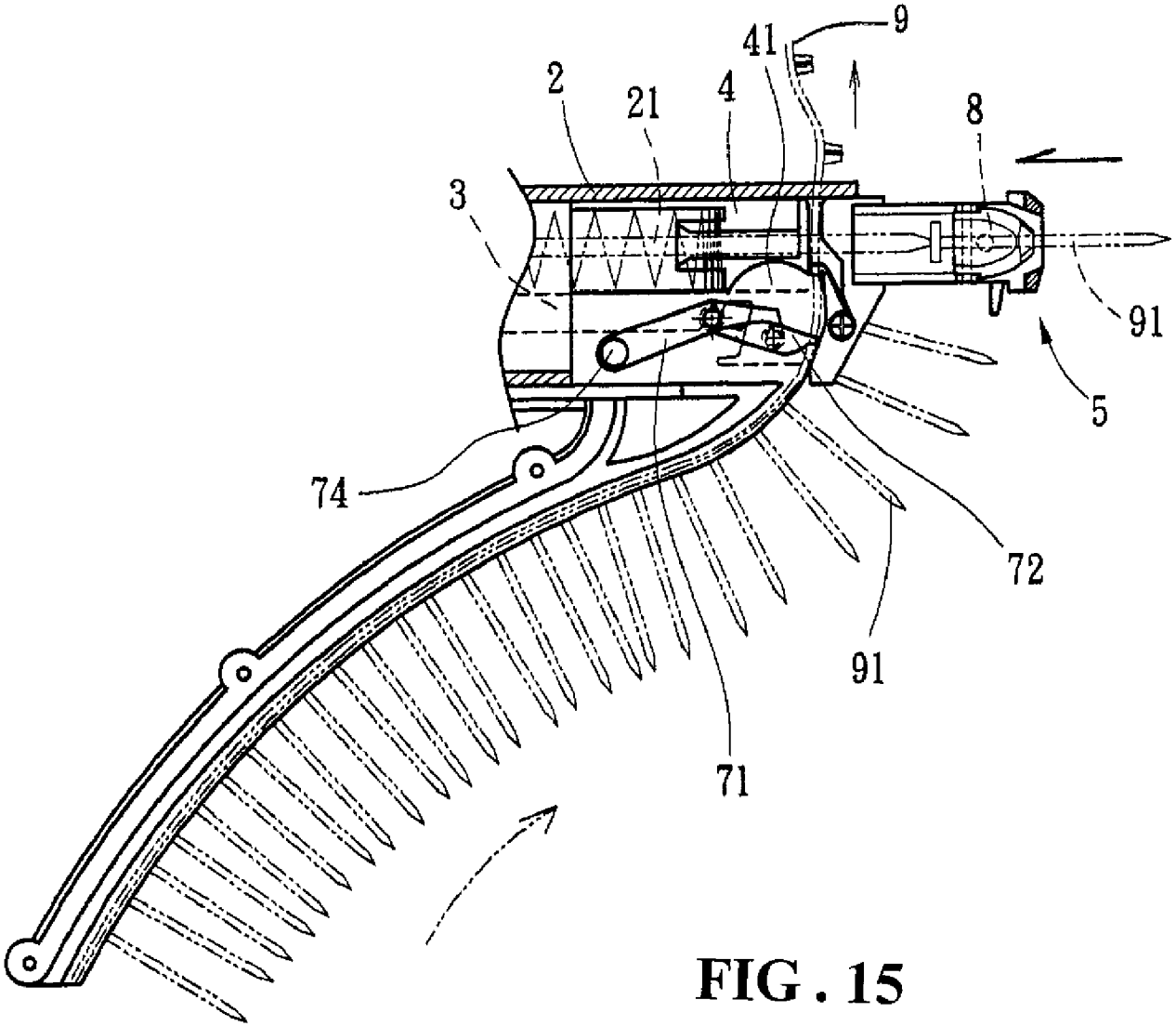
FIG. 15 illustrates the operation of the screw-guiding transmission device and screws.
Figure 16:
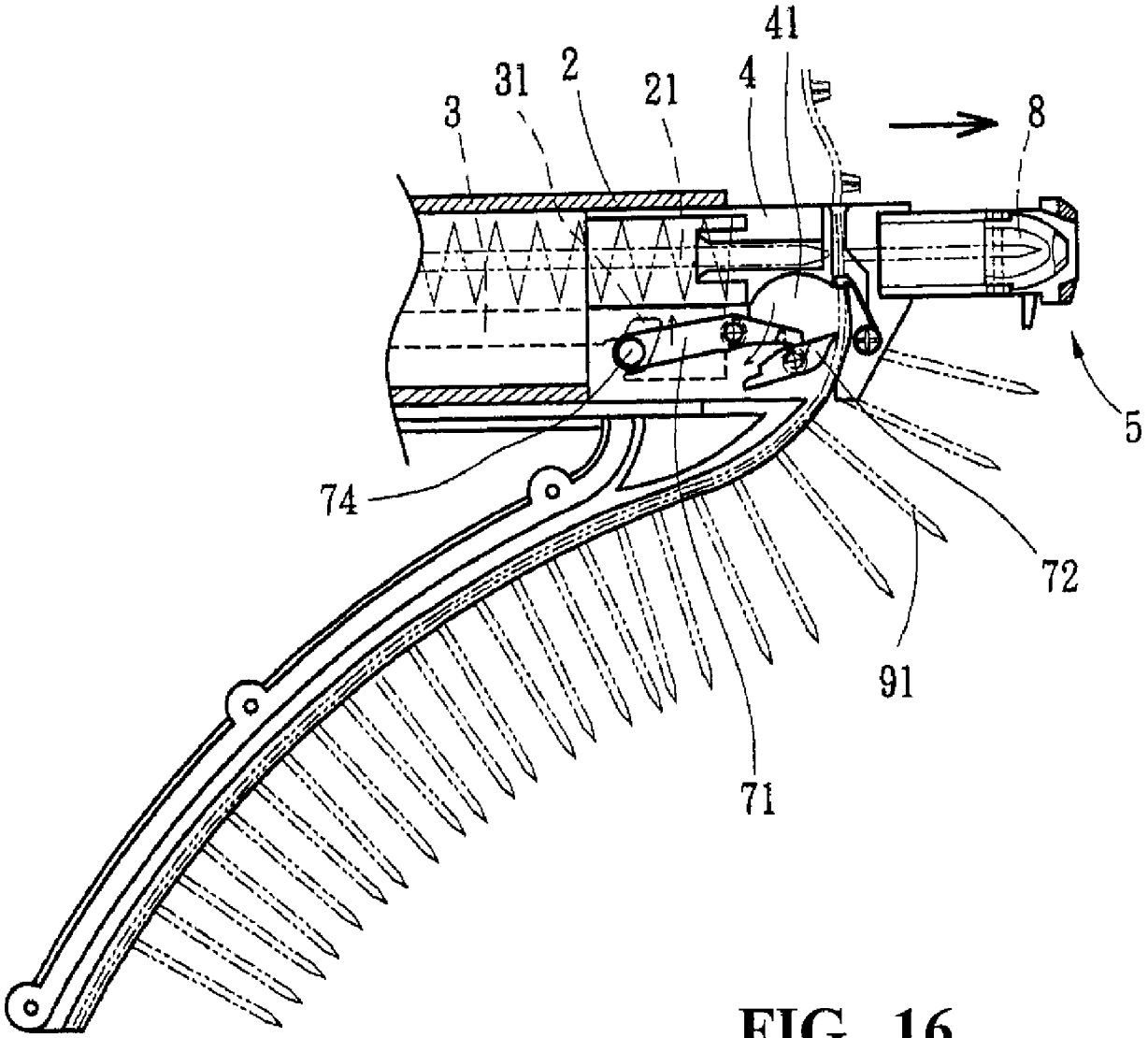
FIG. 16 illustrates the operation of the screw-guiding transmission device and screws in a different condition.

Referring to FIGS. 15 and 16, to operate, a user inserts a screw strip 9 from a lower end of the guide chute 61 of the guide rail 6 to the chamber 41 and causes the engaging slots on the opposite side edges of the screw strip 9 to engage the front ends of the side boards 721 of the driving block 72. Then, the user positions and pushes the positioner 5 against a target object and then forcibly move the device body 1 frontward to cause the movable base 4 to move with respect to and get inward into the stationary base 2. The peg 74 is then moved rearward along the chute 31 of the guide block 3 and synchronously drives the rear end of the transmission bar 71 downward, which causes the pivot portion 712 at the front end of the transmission bar 71 to move upward. At this time, the peg 74 that is moved in a downward and rearward direction from the top end of the inclined U-shaped chute 31 is temporarily stopped by the stop flange 311 and then continues to move horizontally in a rearward direction. This prevents the screw 91 from being not precisely positioned in the predetermined positioning point by an excessive instantaneous force at the time the peg 74 slides downward. Further, the stop block 723 of the rear portion of the driving block 72 abuts at a suitable location against the bottom surface of the front portion of the transmission bar 71 so that the driving block 72 is driven by the pivot portion 712 to move upward and the front ends of the driving block 72 push the engaging slots on the opposite side edges of the screw strip 9 in such a way that the screw strip 9 is moved upward. When the screws 91 is moved upward with the screw strip 9 to enter the strip discharge slot 42, the upper end of the retention resilient plate 44 is extended and located below the strip discharge slot 42, so that the engaging slots on the opposite side edges of the screw strip 9 forcibly move the retention resilient plate 44 away to allow the screw strip 9 to move upward and reach the positioning point inside the strip discharge slot 42. The lower face of the upper end of the retention resilient plate 44 engages the engaging slot of the screw strip 9 to prevent the screw strip 9 from further moving in the up and down direction so as to securely retain and fix the screw 91 at the positioning point inside the strip discharge slot 42. At this time, the user may operate the screw-driving tool 21 to move frontward and screw the screw 91. Further, when the user moves the device body 1 rearward, the movable base 4 is allowed to extend frontward from inside the stationary base 2 and resumes its position, as shown in FIG. 16. The peg 74 moves upward along the chute 31 of the guide block 3 back to the original position (the top end of the chute) and synchronously brings the rear end of the transmission bar 71 upward to resume its position, which causes the pivot portion 712 on the front end of the transmission bar 71 and the driving block 72 to move downward. Since the lower sides of front ends of the two side boards 721 of the driving block 72 form inclined surfaces and since the hooks 732 of the spring 73 respectively engage the suitable locations of the upper edges of the two side boards 721 and the U-shaped connection 733 on the rear side of the spring 73 engages at a suitable location on the top surface of the front portion of the transmission bar 71, the driving block 72 can rotate about the pin 714 that extends therethrough and uses the spring force of the spring 73 to allow the U-shaped connection 733 to no long press against the transmission bar 71, and the front ends of the two side boards 721 of the driving block 72 are allowed to disengage from the engaging slots of the screw strip 9 and move downward for engaging with the next engaging slot of the screw strip 9. By cyclically operating in the same way, the screws 91 carried by the screw strip 9 can be precisely advanced and the screws 91 can be stably held and completely fixed at the positioning point inside the strip discharge slot 42 in the front portion of the movable base 4 to allow for precise pushing and screwing operation performed thereon by the screw-driving tool 21 to complete the full cycle of operation of the screw-guiding transmission device 7 of the present invention.

Figure 14:
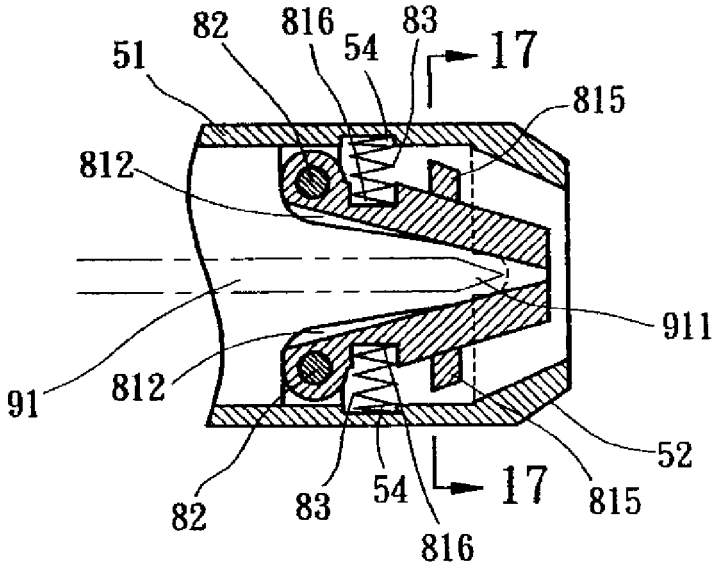
FIG. 14 is a cross-sectional view of the assembled guiding clamp blocks, the pins, and the springs of the guiding and holding device and a screw.
Figure 17:
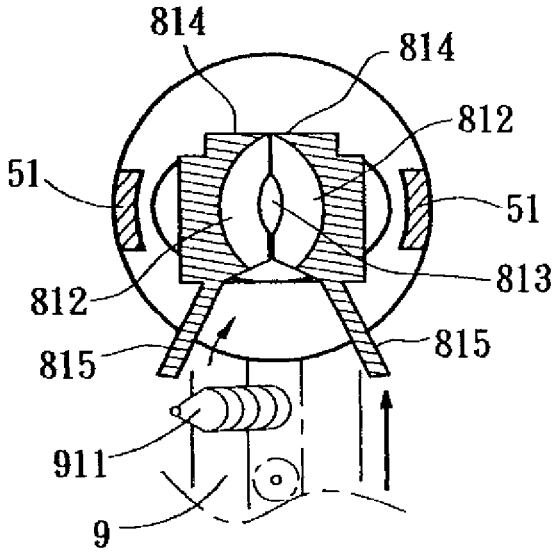
FIG. 17 is a cross-sectional view taken along line 17-17 of FIG. 14.
Figure 18:
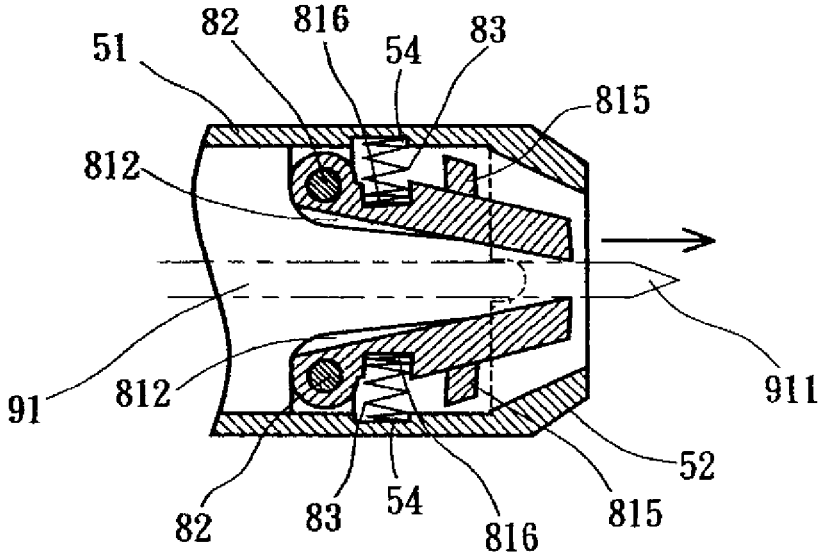
FIG. 18 is a cross-sectional view of the assembled guiding clamp blocks, the pins, and the springs of the guiding and holding device and a screw.
Figure 19:
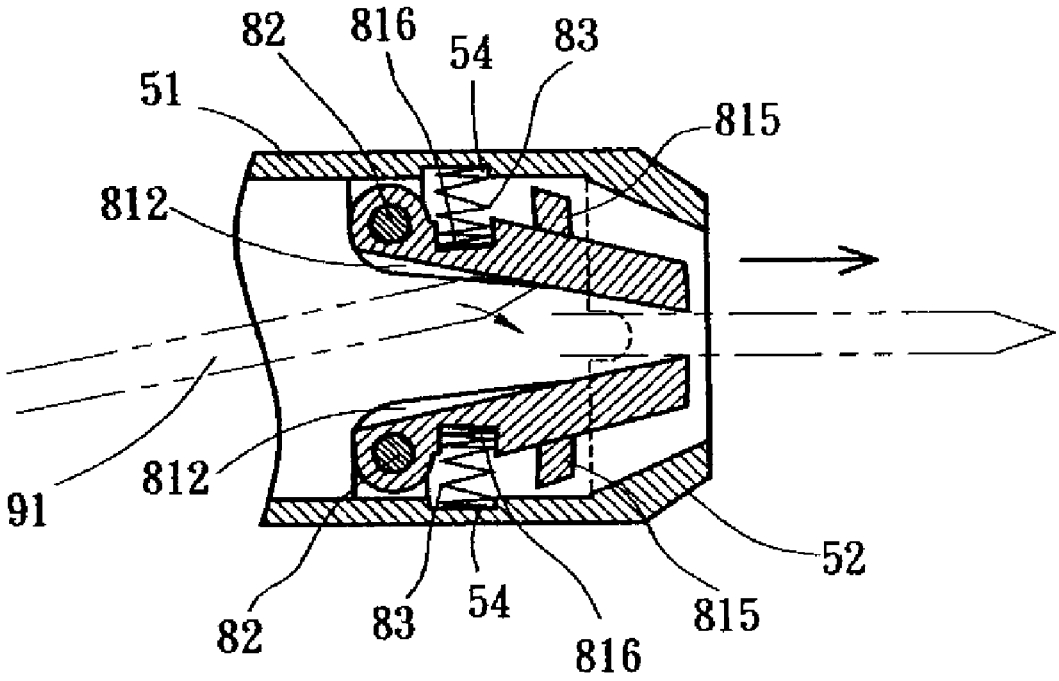
FIG. 19 is a cross-sectional view of the assembled guiding clamp blocks, the pins, and the springs of the guiding and holding device and a screw in a different condition.

Further referring to FIGS. 17-19, when an improperly orientated screw 91 is moved to pass through the recess at the inner edge of the bottom side of the abutting edges 52 from the bottom side of the positioner 5 in order to enter the guiding and holding device 8, since the two symmetric stop guides 815 of the two guiding clamp blocks 81 are extended to the bottom of the abutting edges 52 and inclined outwardly, the sharp tip 911 of the improperly orientated screw 91 is brought into contact with the inside surface of one of the stop guides 815. With the improperly orientated screw 91 continuing moving upward, the sharp tip 911 is moved along the inside surface of the stop guide 815 and continuously gets upward, as indicated in FIG. 17. Thus, the orientation of the improperly orientated screw 91 can be gradually corrected and get into between the arcuate recessed inclined faces 812 of the two guiding camp blocks 81. In addition, since, at this moment, the two guiding clamp blocks 81 are closed with each other, the two stop covers 814 serves to stop further upward movement of the screw 91 after the screw 91 enters the space between the arcuate recessed inclined faces 812. In other words, after the improperly orientated screw 91 enters the space between the arcuate recessed inclined faces 812, further upward movement of the screw 91 is stopped by the two closed stop covers 814 thereby preventing the screw 91 from further moving upward. This prevents the screw 91 from moving beyond the positioning point. Further, at this moment, the improperly orientated screw 91 is guided and corrected by the two stop guides 815 and reaches the positioning point with being no longer improperly orientated whereby the spark tip 911 of the screw is precisely pointing at the space between the recesses 813 at the front end of the two guiding clamp blocks 81, as shown in FIG. 14, and coaxially aligns with the screw-driving tool 21 to allow the screw-driving tool 21 to drive frontward from the rear side for screwing. Further, when the screw-driving tool 21 is moved frontward to drive and screw the screw 91, the body of the screw 91 pushes outward the two guiding clamp blocks 81 for further frontward movement and the space formed between the recesses 813 at the front end of the two guiding clamp blocks 81 maintain the proper orientation of the screw 91, as shown in FIG. 18, thereby keeping the screw move frontward in a straight line until the head of the screw 91 completely passes the two guiding clamp blocks 81 and completing the screwing operation of the screw 91. Thereafter, the spring forces of the two springs 83 resiliently return the two guiding clamp blocks 81 to the closed condition. In this way, the screw 91 can be precisely and correctly screwed onto the target object and no incorrect screwing occurs. Referring to FIG. 19, in case an improperly orientated screw 91 enters the guiding and holding device 8 from the bottom of the positioner 5 and the sharp tip 911 of the screw 91 remains inclined and not aligning with the space between the recesses 813 in the inside surfaces of the front ends of the two guiding clamp blocks 81 and further in case that the screw-driving tool 21 is operated to move frontward to drive and screw the improperly orientated screw 91, the sharp tip 911 of the improperly orientated screw 91, which is driven frontward, is brought into contact with the arcuate recessed inclined face 812 formed in the inside surface of the one guiding clamp block 81. Since the arcuate recessed inclined face 812 is gradually inclined from the front side to the rear side and inward recessed, the sharp tip 911 may move along the arcuate recessed inclined face 812 to gradually get close to the recess 813 at the inside surface of the front end of the guiding clamp block 81. In other words, the arcuate recessed inclined face 812 guides the sharp tip 911 to move frontward and brings the sharp tip 911 to the space formed between the recesses 813 at the inside surfaces of the front ends of the two guiding clamp blocks 81 to finally coaxially aligning thereto. As such, the body of the improperly orientated screw 91 can be supportively held by the two recesses 813 to move frontward in a straight line and screwed to the target object and thus, the sharp tip of the screwed and frontward driven screw can be guided and corrected to the desired direction and the body of the screw can be supportively held.

Although the present invention has been described with reference to the preferred embodiments thereof it is apparent to those skilled in the art that a variety of modifications and changes may be made without departing from the scope of the present invention which is intended to be defined by the appended claims.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A screw fastening device comprising a device body from which a stationary base extends frontward, a screw-driving tool arranged in the device body and extending into the stationary base, a guide block fixed to an inside surface of a movable base coupled to and extending outside the stationary base and movable with respect to the stationary base, a positioner fixed to a front end of the movable base, a guide rail extending from a bottom of the movable base, a screw-guiding transmission device arranged at a location inside the movable base, and a guiding and holding device mounted inside the positioner, wherein a curved guide rail extends from the bottom of the movable base, a front surface of the guide rail being recessed and forming a guide chute, which is extended upwardly from a lower end to a chamber defined in the movable base, a strip discharge slot being formed at a location in the chamber to align to the guide chute to allow a screw strip to pass therethrough for assembling and operation, a shaft being arranged at a location inside the chamber for mounting a transmission bar of the screw-guiding transmission device, characterized in that the screw-guiding transmission device comprises the transmission bar, a driving block, a spring, and a peg, wherein the transmission bar forms a threaded hole at a rear portion thereof for threadingly engaging the peg and forms a through hole rotatably fitting over said shaft so that the transmission bar is securely fixed inside the chamber and rotates about the shaft, a front end of the transmission bar being extended to form a pivot portion through which a hole is formed for the extension of a pin for mounting the driving block on opposite sides of the pivot portion, the driving block having a U-shape, comprising two side boards with aligned holes defined in the side boards and corresponding to the hole of the pivot portion, front ends of the two side boards being provided with a projected tooth like configuration, which has an inclined surface at a lower side thereof, to engage engaging slots formed on two side edges of the screw strip, a stop block being formed at a rear portion between the two side boards abuttingly engageable with a bottom surface of a front portion of the transmission bar at a location, the spring being received between inside faces of the two side boards, the spring comprising two coils, a hook being extended from and formed at a front side of each coil, a U-shaped connection being formed between the coils at a rear side thereof and put against at a location on a top surface of the front portion of the transmission bar, whereby when the peg moves along the chute of the guide block, the transmission bar is driven, and the front end of the transmission bar is rotated about the shaft to causes the driving block to move up and down and the front ends of the side boards of the driving block engaging the engaging slots on the opposite sides of the screw strip for moving a screw carried on the screw strip into the strip discharge slot to reach a predetermined positioning point, the driving block using a spring force of the spring and rotatable about the pin extending therethrough to have the inclined surfaces at the lower sides of the front ends thereof moving from the engaging slots of the screw strip to next engaging slots and engaging therewith for precise advancing of the screw strip and securely and holding and completely fixing the screw at the positioning point in the strip discharge slot for precise screwing operation of the screw.

2. The screw fastening device as claimed in claim 1, wherein a threaded hole is defined at a location at one side of a front curved edge of the chamber for threadingly fixing a bolt, a channel being extended from the threaded hole and inclinedly corresponding to a strip discharge slot for retaining a retention resilient plate, a lower end of the retention resilient plate being fixed by the bolt and an upper end being extended and located below the strip discharge slot to engage engaging slots of the screw strip so as to prevent the screw strip from arbitrarily moving up and down and thereby securely holding and completely fixing a screw at a predetermined positioning point in the strip discharge slot.

* * * * *